US011053620B2

(12) United States Patent
Alif

(10) Patent No.: US 11,053,620 B2
(45) Date of Patent: Jul. 6, 2021

(54) LAUNDRY SYSTEM

(71) Applicant: Omaid Alif, Richmond Hill (CA)

(72) Inventor: Omaid Alif, Richmond Hill (CA)

( * ) Notice: Subject to any disclaimer, the term of this patent is extended or adjusted under 35 U.S.C. 154(b) by 181 days.

(21) Appl. No.: 16/386,575

(22) Filed: Apr. 17, 2019

(65) Prior Publication Data

US 2020/0332449 A1 Oct. 22, 2020

(51) Int. Cl.

| | |
|---|---|
| ***D06F 33/02*** | (2006.01) |
| ***D06F 33/00*** | (2020.01) |
| ***D06F 89/00*** | (2006.01) |
| ***D06F 29/00*** | (2006.01) |
| *D06F 58/16* | (2006.01) |
| *D06F 58/38* | (2020.01) |

(52) U.S. Cl.

CPC ..... *D06F 33/00* (2013.01); *D06F 29/005* (2013.01); *D06F 89/00* (2013.01); *D06F 58/16* (2013.01); *D06F 58/38* (2020.02); *D06F 2202/10* (2013.01); *D06F 2202/12* (2013.01)

(58) Field of Classification Search

CPC .... D06F 33/00; D06F 29/005; D06F 2202/10; D06F 2202/12; D06F 89/00; D06F 58/16; D06F 58/38

USPC ..... 68/12.02

See application file for complete search history.

(56) References Cited

U.S. PATENT DOCUMENTS

| | | | | |
|---|---|---|---|---|
| 2009/0045231 | A1* | 2/2009 | Saji | D06F 89/02 223/37 |
| 2011/0271719 | A1* | 11/2011 | Fujitsuka | D06F 37/04 68/134 |
| 2017/0218558 | A1* | 8/2017 | Han | D06F 37/04 |
| 2018/0320305 | A1* | 11/2018 | Kang | D06F 53/00 |

OTHER PUBLICATIONS

EP2474659B1—Machine translation (Year: 2013).*

* cited by examiner

*Primary Examiner* — Tinsae B Ayalew

(74) *Attorney, Agent, or Firm* — Capehart Law Firm

(57) ABSTRACT

A clothing apparatus having a container being of a rectangular configuration. A clothing cleaning assembly is located within the container. The clothing cleaning assembly has a spherical configuration and a hollow interior configured to receive dirty laundry for washing. A rotational assembly is connected to the clothing cleaning assembly to provide rotation to the clothing cleaning assembly to provide movement during the wash cycle. A robotic arm assembly is located within the container and having at least one robotic arm having a plurality of fingers configured to grip articles of clothing attached at an operational end of the at least one robotic arm. The at least one robotic arm is configured to transport the articles of clothing within the container. At least one computer system is located within the container and is configured to provide operational control to the clothing apparatus.

5 Claims, 9 Drawing Sheets

LAUNDRY SYSTEM

REFERENCE TO PENDING APPLICATIONS

This application does not claim the benefit of any issued U.S. patent or pending application.

TECHNICAL FIELD

The present invention relates generally toward a clothes handling apparatus, and more specifically, to a self-contained washing, drying and folding apparatus for articles of clothing.

BACKGROUND

Generally, the handling of articles of clothing is one of the most labor-intensive areas of a household. A typical house usually includes a washing machine along with either a dryer or a clothes line to dry wet washed clothing. Further, clean and dry clothes are manually folded following the drying cycle. Due to the time to perform these actions, there is an ongoing need to provide laundry devices that can reduce the time to perform such duties.

Various prior art devices have attempted to address this need.

EP 1942223A2 is directed toward a household device for manipulating laundry. This device has a manipulator to supply washing items of a washing machine or a laundry dryer, and to remove them from the washing machine or the laundry dryer. A reader is provided for wireless selection of labels at the washing items which are selected by radio communication.

US Patent Publication No. 2006/0137205 is directed toward a composite washing system. This system discloses a washing system which is capable of continuously circulating laundry-drying air through dryers.

U.S. Pat. No. 5,715,555 is directed toward a smart laundry system and method. The system discloses a smart laundry system and method including a tag communicating device for reading laundering instructions and water processing information contained in an electronic tag attached to a material item while the material item is within a laundry machine.

U.S. Pat. No. 8,820,594 is directed toward a folding system for fabric product. The system discloses an information obtaining device, a folding device and a width controlling device.

JP5024905B2 is directed toward a clothing folding system. The system discloses a technique for instructing a garment folding procedure for the robot.

US Patent Publication No. 2009/0120972 is directed toward a clothing folding machine. The machine discloses a folding mechanism including a width direction folding section and a length direction folding section for folding a garment hung on a hanger in a horizontal direction and a vertical direction into a predetermined size.

CN105926257 is directed toward a machine capable of conveniently folding clothes. The machine discloses an upper cover, a housing, a base, a manipulator arm module, a chain transmission module and an automatic clothes folding module.

EP2369051A1 is directed toward a method for finishing of washed pieces of washing and dryer. The method discloses drying, folding and de-stacking laundry pieces after washing and draining the laundry pieces in a dryer.

CN205358782U is directed toward an intelligence wardrobe device. The device discloses a wardrobe main part, intelligent terminal, control processing system and clothing database.

While the prior art demonstrate various efforts to reduce the time to perform laundry care company, there is a need to provide an improved apparatus which can reduce the time and energy to perform laundry care.

SUMMARY

The present invention relates generally toward a clothes handling apparatus, and more specifically, to a self-contained washing, drying and folding apparatus for articles of clothing.

In one aspect, a clothing apparatus is disclosed. The clothing apparatus includes a container being of a rectangular configuration. Within the container is a clothing cleaning assembly. The clothing cleaning assembly is of a spherical configuration and has a hollow interior configured to receive dirty laundry for washing. The clothing cleaning assembly has a washing water input, a washing detergent input, and a water drain. The interior surface of the washing assembly has a plurality of grooves to provide agitation to during a wash cycle.

Further, within the container is a rotational assembly connected to the clothing cleaning assembly. The rotational assembly provide rotational movement to the clothing cleaning assembly during a wash cycle.

Further, within the container is a robotic arm assembly having at least one robotic arm. The at least one robotic arm has a plurality of fingers attached at an operational end of the at least one robotic arm. The plurality of fingers are configured to grip articles of clothing. The at least one robotic arm is configured to transport the articles of clothing within the container.

Further, within the container is at least one computer system configured to provide operational control to the clothing apparatus. The at least one computer system has at least one computer processor, at least one memory storage device and operational software that is stored in the at least one memory storage device and processed by the at least one computer processor.

In some aspects, the clothing apparatus may further include a dirty clothes container. In these aspects, the robotic arm assembly is configured to move dirty clothes from the dirty clothes container to the clothes cleaning assembly.

In some aspects, the clothing apparatus may further include a heating apparatus configured to provide heat to the interior of the clothing cleaning assembly during a drying cycle. A vent apparatus may be include to allow the venting of heated air from the interior of the clothing cleaning assembly during a drying cycle. In these aspects, the robotic arm assembly is configured to move dirty clothes from the dirty clothes container to the clothes cleaning assembly.

In some aspects, the clothing apparatus may further include a drying assembly to provide drying to a piece of wet article of clothing following a wash cycle. In these aspects, the robotic arm assembly is configured to move wet articles of clothing from the clothes cleaning assembly following the wash cycle onto the drying assembly. The drying assembly may be a drying rod assembly located within the interior of the container that may be configured to be extendable outside of the container. Further, the drying assembly may further include at least one moisture sensor configured to determine the dryness of the article of clothing located on the drying rod assembly.

In some aspects, the clothing apparatus may further include a folding assembly located within the container. In these aspects, the robotic arm assembly is configured to move dry articles of clothing onto the folding assembly.

In some aspects, the clothing apparatus may further include a clothing data processing assembly that is in communication with the at least one computer system. The clothing data processing assembly may be configured to determine clothing data of the article of clothing and may have at least one sensor. The clothing data may include the type of article of clothing, size of article of clothing, fabric type, color of article of clothing and weight of article of clothing.

Other aspects and features of the present invention will become apparent to those ordinarily skilled in the art upon review of the following description of specific embodiments of the invention in conjunction with the accompanying figures.

BRIEF DESCRIPTION OF THE DRAWING

In drawings which illustrate embodiments of the invention wherein similar characters of reference denote corresponding parts in each view.

DETAILED DESCRIPTION OF THE INVENTION

Figure 1:
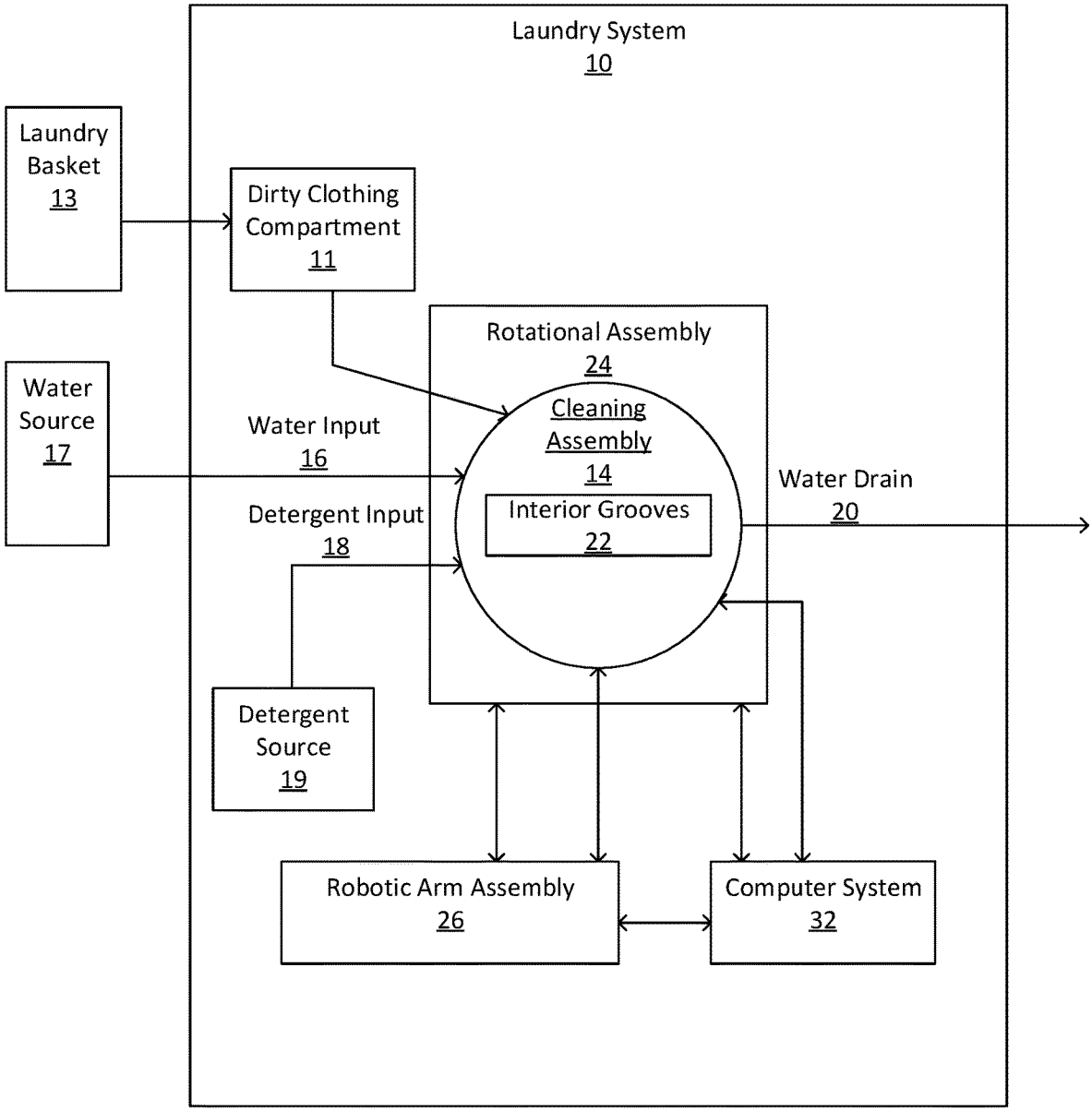
FIG. 1 is schematic view of an embodiment of the present invention.

The present invention is directed toward the washing and drying of articles of clothing. Embodiments of the present invention will utilize the series of robotic arms to facilitate the washing, drawing and folding of the garments or articles of clothing.

As illustrated in the FIGS, an embodiment of the laundry system 10 of the present invention is disclosed. Laundry system 10 includes a container 12 being of a rectangular configuration. Container 12 may include a dirty clothing compartment 11. Dirty clothing compartment 11 may be accessed through an opening within container 12 and may be configured to be receive a standard laundry basket 13.

A clothing cleaning assembly 14 is located within the container 12 and has a spherical configuration. Clothing cleaning assembly 14 has a hollow interior and an opening that is configured to receive dirty laundry for washing. A plurality of grooves 22 along an interior surface of the clothing cleaning assembly 14 provide agitation to during a wash cycle. The clothing cleaning assembly 14 further includes a washing water input 16 connected to a water source 17, such as a water tank or external water line, a washing detergent input 18 connected to a detergent source 19, such as a detergent reservoir located within container 12, and a water drain line 20 configured to drain used, or grey water, from clothing cleaning assembly 14. Clothing cleaning assembly 14 may be constructed of known materials suitable for housing clothing, water, detergent and other laundry cleaning items, along with materials suitable for the cleaning thereof.

A rotational assembly 24 is connected to the clothing cleaning assembly 14. Rotational assembly provides rotational movement to the clothing cleaning assembly 14 to provide movement during the wash cycle. In some embodiments, rotational assembly 24 may include one or more electric motors in combination with a plurality of cylinder-shaped rotors connected to the outside of the clothing cleaning assembly 24 that provide rotational movement. However, those skilled in the art will recognize that other configurations of a rotational assembly 24 that is capable of providing rotational movement to clothing cleaning assembly 14 may be utilized.

An example of the clothing cleaning assembly 14 and the rotational assembly 24 is set out. In this example, clothing cleaning assembly is a generally spherical drum that sits inside a generally cube-shaped rotational assembly 24. Various motors are located at the corners of the rotational assembly to allow for a maximum size for the clothing cleaning assembly 14. The clothing cleaning apparatus 14 would include two nested spheres, or drums, where the inner drum has paddles and holes and houses the clothing when being washed and dried. The outer drum houses the attachments, such as attachment rings, that provide movement to the inner drum. The outer drum is further configured to collect the waste water.

Regarding the motors, a first set of two motors are positioned in opposite corners from each other and provide rotational movement to the inner drum. A second set of motors are aligned perpendicular to the first set of motors. The second set of motors provide additional movement to the inner drum to allow the inner drum to rotate in all directions. In some examples, the motors may be split phase induction motors.

In these examples, water and hot air may be provided through one or more access pipes. These pipes may be attached to the shafts of the motors or to other suitable attachment locations.

Various additional components may be included including piping to remove hot moisten air out of the inner drum. The hot moisten air may be directed through one or more pipes to drying clothing to be used to provide steam to those clothes. Further, the pipes may have a lint collector/screen to capture lint.

Figure 2:
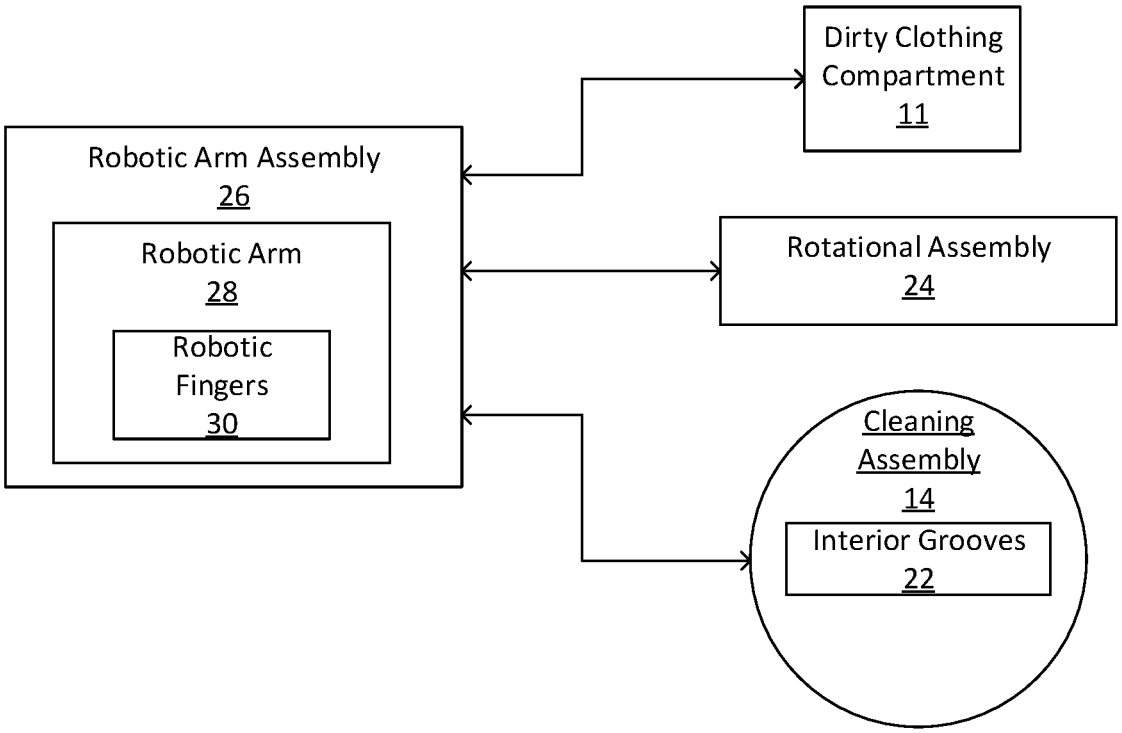
FIG. 2 is schematic view of an embodiment the robotic arm assembly of the present invention.
Figure 3:
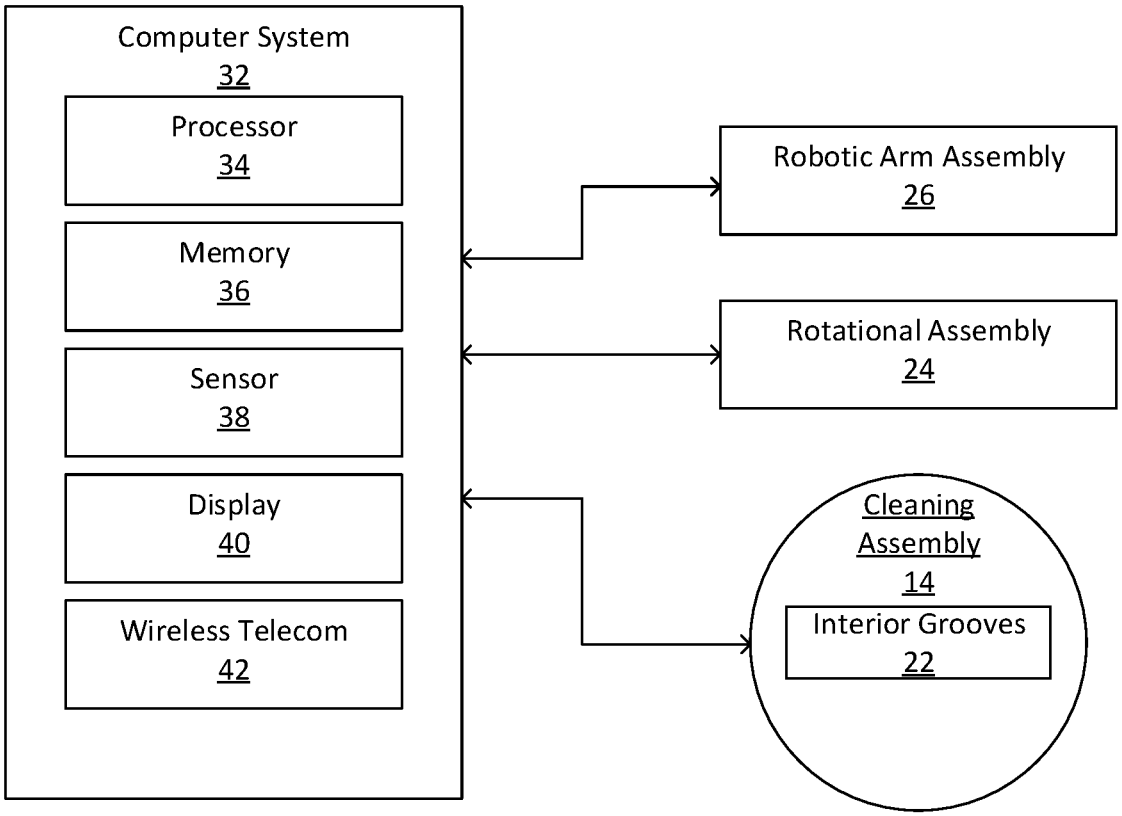
FIG. 3 is schematic view of an embodiment of the computer system of the present invention.

A robotic arm assembly 26 is located within the container 12. Robotic arm assembly 26 may be any known robotic arm assembly that is capable of grasping, moving and manipulating an article of clothing. In some embodiments, as illustrated in FIG. 2, robotic arm 26 has at least one robotic arm 28, which includes a plurality of fingers 30 attached at an operational end of the at least one robotic arm 28. The plurality of fingers 30 are configured to grip articles of clothing.

In some embodiments, the at least one robotic arm 28 may have two or more dimensional rotational joints along with a plurality of pivotable fingers 30 for gripping individual articles of clothing. The robotic arm 28 may be capable of selecting articles of clothing and transporting those articles of clothing within the container 12. For example, the robotic arm 28 may be capable of gripping an article of clothing from within the dirty clothes compartment 11 and placing them in the clothes cleaning assembly 14 for a wash cycle.

In some embodiments, the robotic arms 28 may include a plurality of fingers 30, such as four fingers, with each finger being pivotable for gripping a piece of an article of clothing. Further, the fingers may have various additional functions associated therewith. For example, one finger may provide water into the clothes cleaning assembly sphere during the cleaning cycle. This finger would be connected to a water source and having a waterjet to provide the water into the assembly. Another finger may provide laundry detergent into the clothes cleaning assembly. This figure would be in communication with the laundry detergent component of the container. Another finger may be utilized and configured in a pivotable position opposite the remaining fingers and utilized as an opposable thumb. The robotic arm assembly 28 may form part of the clothes cleaning assembly 14, such that the robotic arm assembly 28 would be attached to a portion of the clothes cleaning assembly 14.

A computer system 32 is also located within the container 12 and provides operational control to the laundry system 10. The computer system 32 includes at least one computer processor 34, at least one memory storage device 36 and at least one sensor 38. Operational control includes providing control over the various elements of the laundry system 10, including the clothing cleaning assembly 14, the rotational assembly 24 and the robotic arm assembly 26. The at least one sensor 38 is configured to provide clothing information to the computer system 32 such that presence of dirty clothing in the dirty clothing compartment 11 or in the clothing cleaning assembly 14.

The control and operation of the computer system 32 may be controlled by an externally mounted display screen 40, which may have onscreen touch capability. Further, the computer system 32 may include hardware and software to allow for wireless control 42 of the computer system 32.

In operation, dirty clothing is loaded into the dirty clothing compartment 11. One or more robotic arms 28 would grip an article of dirty laundry from within the dirty clothing compartment 11 and transfer that article of dirty laundry into the interior of clothing cleaning assembly 14. Washing water and detergent are then provided into the interior of clothing cleaning assembly 14. Rotational assembly 24 engages clothing cleaning assembly 14 to provide rotational movement to clothing cleaning assembly 14. Agitation of the water, detergent and laundry is caused by the movement thereof over the grooves 22. Once the wash cycle is complete, the dirty wash water is evacuated from the clothing cleaning assembly 14 through water drain 20.

Figure 4:
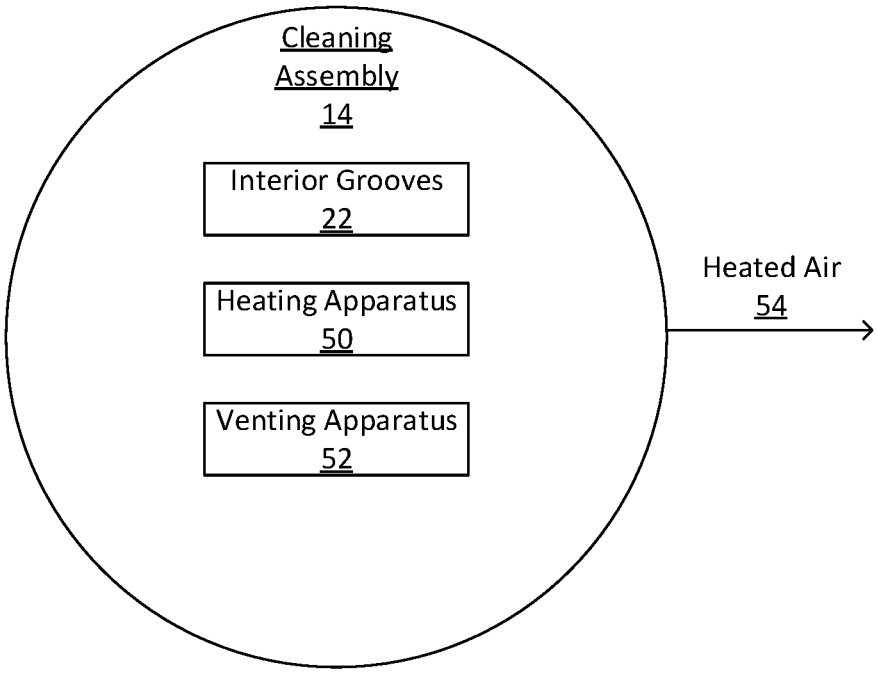
FIG. 4 is schematic view of an embodiment of the cleaning assembly of the present invention.

In some embodiments, as illustrated in FIG. 4, the drying of an article of clothing may be maintained within the clothing cleaning assembly 14. In these embodiments, a heating apparatus 50 and a vent apparatus 52 are provided. The heating apparatus 50 may include a heating element that is configured to provide heat to the interior of the clothing cleaning assembly 14 during a drying cycle. The vent apparatus 52 may include a combination of a fan and a vent pipe which is configured to allow the venting of heated air 54 from the interior of the clothing cleaning assembly 14 during the drying cycle.

Figure 5:
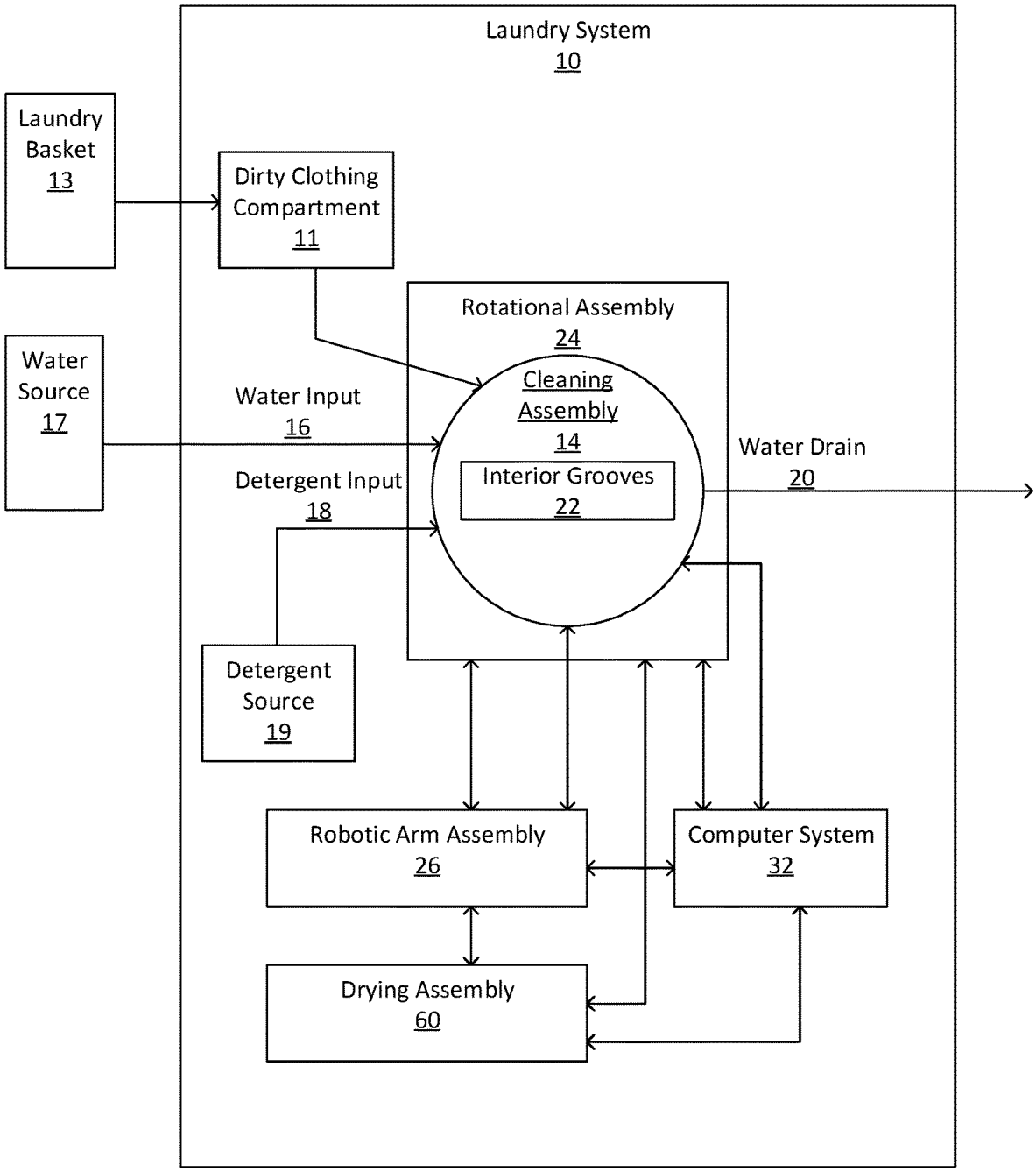
FIG. 5 is schematic view of an additional embodiment of the present invention.

In some embodiments, as illustrated in FIG. 5, the laundry apparatus 12 may further include a drying assembly 60 to provide drying to a piece of wet article of clothing following a wash cycle. In these embodiments, the robotic arm assembly 26 is configured to move wet articles of clothing from the clothes cleaning assembly 14 following the wash cycle onto the drying assembly 60.

Figure 6:
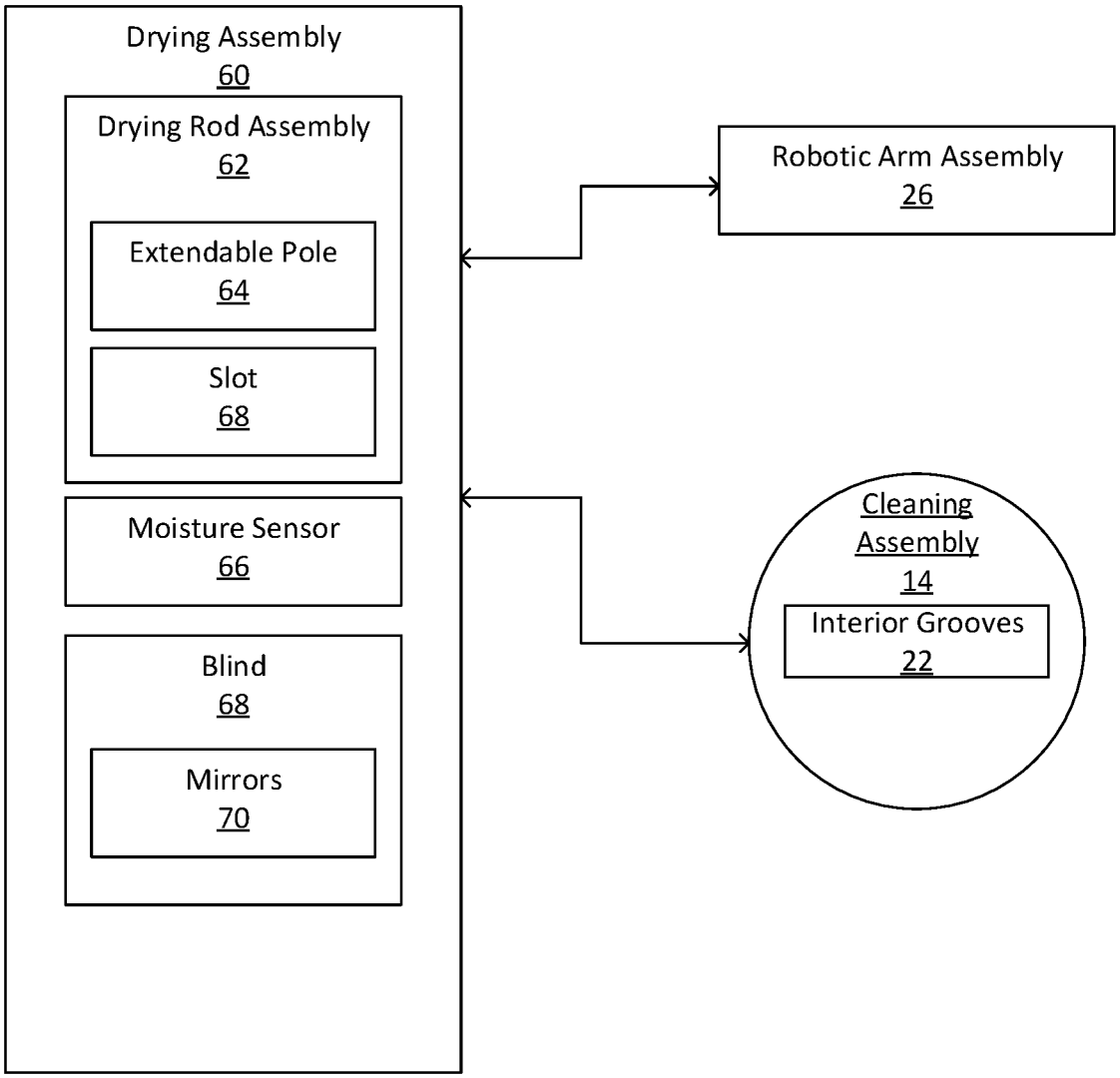
FIG. 6 is schematic view of an embodiment of the drying assembly of the present invention.

On embodiment of the drying assembly 60, as illustrated in FIG. 6, includes a drying rod assembly 62 located within the interior of the container 12. Drying rod assembly 62 may include an extendable pole 64 that may be used for the hanging articles of clothing for drying. In some embodiments, the extendable pole may extend beyond the external walls of the container 12. In such an embodiment, drying rod assembly 62 may include various mechanical devices known in the art sufficient to extend extendable pole 64 beyond the external walls, such as link chains, motors and/or pulley systems, and to contract the extendable pole 64 completely within container 12 when not in use. the Further, the extendable pole assembly 62 may also include a slot 68 that can be closed during nonuse and opened when the pole extends. In this embodiment, a single extendable pole assembly 62 utilized a single pole 64. This is illustrated and not meant to be limiting. Those skilled in the art will recognize that multiple poles may be utilized and would be within the scope of this disclosure.

In operation, the robotic arm assembly 26 would be configured to remove a wet article of clothing following a wash cycle from the clothes cleaning assembly 14 and place that article of clothing on the extendable pole 64. The extendable pole 64 would extend allowing the article of clothing attached thereto to pass through the slot into the open air outside of the container for drying. The drying cycle may be based on a set amount of time, or a determination of dryness of the articles of clothes, or may be based on a time set by an air exchange rate that may be determined from local weather stations. A moisture sensor 66 may be utilized to determine the level of dryness. The moisture sensor 66 may be contained within the drying assembly 60 or inside the container 12.

In additional embodiments, as the drying of an article of clothing may be maintained within the interior of the container but be performed through the hanging of the article of clothing on the extendable pole which is not extended through the slot 68 but rather remains inside the interior of container 12. In such embodiments, the drying assembly may include a blind 68 which is located along an outer wall of container 12. Blind 68 may be opened to allow sunlight and warm air to enter into the interior of the container 12 in order to provide warmth and drew a drying effect on to the article of clothing contained on or attached to the extendable pole 64. When the drying assembly 60 dries the articles of clothing within the container 12, the blind 68 around the opening for drying clothes may include one or more mirrors 70 to allow sunlight to reflect from different angles. In some embodiments, blind 68 may include a window screen attached thereto. The window screen would be configured to prevent insects, leaves and other items from entering into container 12.

Figure 7:
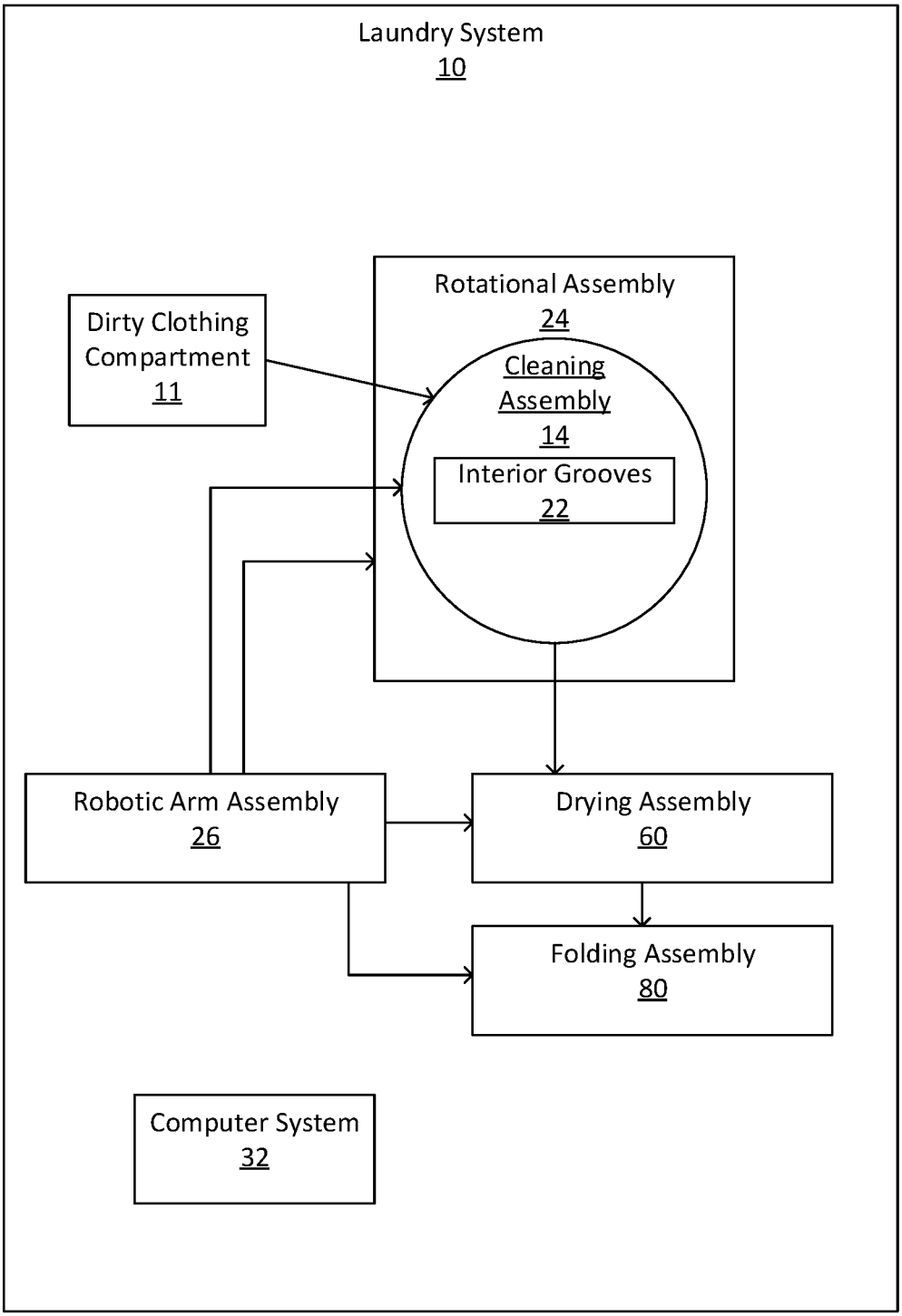
FIG. 7 is schematic view of an additional embodiment of the present invention.
Figure 8:
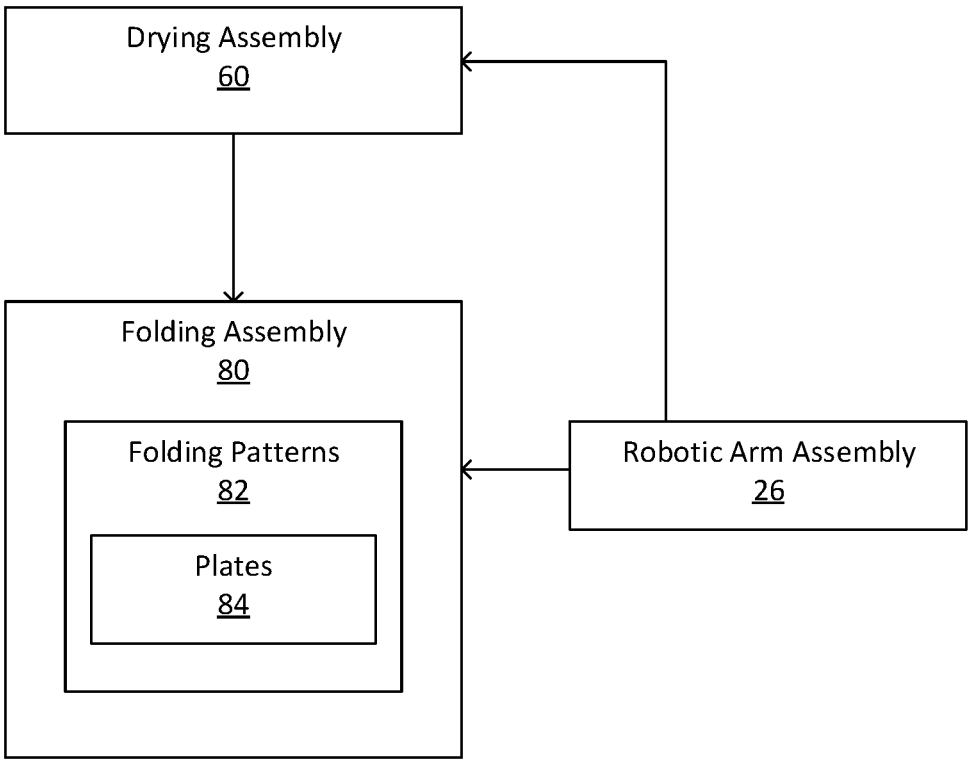
FIG. 8 is schematic view of an embodiment of the folding assembly of the present invention.

In other embodiments, as illustrated in FIGS. 7 and 8, a folding assembly 80 may be included within the container 12. The folding assembly 80 may provide the capability of folding clean articles of clothing following the completion of a drying cycle. The folding assembly 80 may include one or more folding patterns 82 made from one or more plates 84. Further, the robotic arm assembly 26 may also be configured to provide the necessary movement to the articles of clothing within the folding assembly 80 to fold the articles of clothing.

Figure 9:
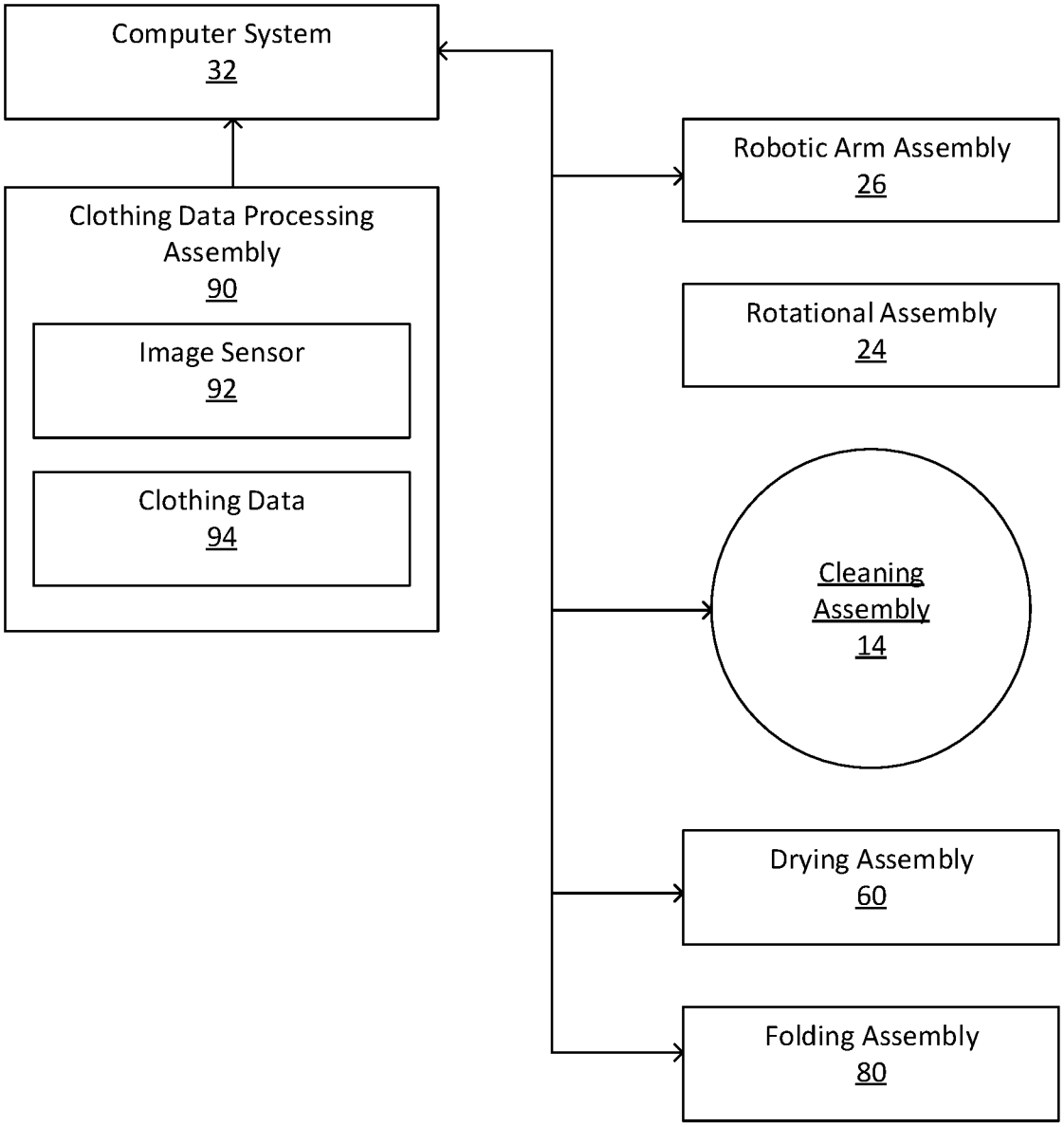
FIG. 9 is schematic view of an embodiment of the clothing data processing assembly of the present invention.

In some embodiments, as illustrated in FIG. 9, the laundry system 10 may also include a clothing data processing assembly 90 in communication with the computer system. The clothing data processing assembly 90 includes at least one image sensor 92 configured to determine clothing data 94 of the articles of clothing. The clothing data 94 may include type of article of clothing, size of article of clothing, fabric type, color of article of clothing and weight of article of clothing. By using the clothing data 94, the laundry system 10 may be capable of various actions, such as sorting the clothing prior to a wash cycle, determining the amount of laundry detergent based on the weight of the articles of clothing to be washed, and identifying an article of clothing as a adult shirt or a child's pants, folding the articles of clothing based on the type of clothing.

Further, the clothing data assembly 90 may be utilized to assist the robotic arm assembly 26 during the folding procedure of the clothing. The images obtained by the clothing data assembly 90 may be used to help align the various articles of clothing within the robotic arm assembly 26 such that the article of clothing may be appropriately folded.

In some embodiments, the container may include various features. These features may include a solar powered system to provide power to the container; a standard water line to provide water to the container; a standardized laundry basket that may be removably placed inside the container in order to assist with any calibration of the weight sensors; a standardized clothes hanger size to assist with the calibration of the weight sensors; a lint filter to allow for the removal of any lint build up; one or more detergent reservoirs that can send an alarm when its volume is low and to allow for the storage of detergent and related cleaning products, including launder powder, detergent cake, laundry liquid, stain and odor eliminator, fabric softeners (liquid and sheets), bleach (both chlorine and oxygen), boosters, enzyme presoaks, prewash soil and stain removers, starches, fabric finishes and sizing, and water softeners. even baking soda, vinegar, and scent boosters. Additionally, ultra-sonic emitters may be included within the inner drum to assist with the cleaning of the clothes through sonic emissions. These features may be constructed from known designs and materials.

In some embodiments, the clothing data processing assembly may be configured to determine identify the various articles of clothing to be cleaned and may be used to assist in determining: weight of the item and other attributes such as size, weight distribution, measurements, colors, fabrics type, seams, stitches, designs, folds, flaps, collars, sleeves, and any transparency. In these embodiments, high sensitivity cameras, such as a fiberoptic or milliscope camera, and sensors may be included to assist with the identification of the articles of clothing. The clothing date processing assembly may also be configured to inspect any clothing tag that may describe the manufacturer, and any specific cleaning instructions.

The clothing data collected may be stored. An identification tag may be created and secured to the article of clothing to allow the system to quickly retrieve any past information about the item of clothing.

In some embodiments, robotic arms may be configured to inspect pockets and remove any item therein. Any removed item may be placed in a compartment for retrieval by the user. Further, the robotic arms may be configured to fold or hang the clothes pursuant to the user's preference. Along with the robotic arms, an endoscope camera may be used to probe inside and outside of clothing and the washing drum and other parts of the machine.

In some embodiments, the system may also include a steamer component, a sewing machine component configured to repair damaged clothing items and an iron component configured to provide ironing services to straighten out wrinkles.

While some embodiments of the present inventive concept have been shown and disclosed herein, it will be obvious to those persons skilled in the art that such embodiments are presented by way of example only, and not as a limitation to the scope of the inventive concept. Variations, changes, and substitutions may occur or be suggested to those skilled in the art without departing from the intent, scope, and totality of this inventive concept. Such variations, changes, and substitutions may involve other features which are already known per se and which may be used instead of, in combination with, or in addition to features already disclosed herein. Accordingly, it is intended that this inventive concept be inclusive of such variations, changes, and substitutions, and by no means limited by the scope of the claims presented herein.

I claim:

1. A laundry apparatus comprising:

a container being of a rectangular configuration;

a clothing cleaning assembly located within the container, the clothing cleaning assembly being of a spherical configuration and having a hollow interior configured to receive dirty laundry for washing, the clothing cleaning assembly having a washing water input, a washing detergent input, and a water drain; the interior surface of the clothing cleaning assembly having a plurality of grooves to provide agitation to during a wash cycle, the clothing cleaning assembly further including, a heating apparatus configured to provide heat to the interior of the clothing cleaning assembly during a drying cycle; and a vent apparatus configured to allow the venting of heated air from the interior of the clothing cleaning assembly during a drying cycle;

a rotational assembly connected to the clothing cleaning assembly to provide rotation to the clothing cleaning assembly to provide movement during the wash cycle;

a dirty clothes container located within the container;

a drying assembly located within the container, the drying assembly configured to provide drying to a piece of wet article of clothing following a wash cycle, the drying assembly including a drying rod assembly and at least one moisture sensor configured to determine the dryness of the article of clothing located on the drying rod assembly;

the drying assembly further including a slot providing access between the interior of the drying assembly and the outside of the container, the slot being configured to be open during use and closed during non-use, the drying rod assembly including an extendable drying rod completely located within the interior of the drying assembly when not in use, the extendable drying rod being configured to extend through the slot to the outside of the container when in use;

a robotic arm assembly having at least one robotic arm, the at least one robotic arm having a plurality of fingers attached at an operational end of the at least one robotic arm, the plurality of fingers being configured to grip articles of clothing, the at least one robotic arm being configured to transport the articles of clothing, the robotic arm assembly being configured to move dirty clothes from the dirty clothes container to the clothes cleaning assembly, the robotic arm assembly being configured to move wet articles of clothing from the clothes cleaning assembly following the wash cycle onto the drying assembly; and at least one computer system configured to provide operational control to the laundry apparatus, the at least one computer system having at least one computer processor and at least one memory storage device.

2. The laundry apparatus of claim 1, wherein the container further comprises at least one opening in at least one exterior wall configured to provide sunlight onto the interior of the container to assist with the drying of articles of clothing located on the drying rod assembly.

3. The laundry apparatus of claim 1, further comprising:

a folding assembly located within the container, wherein the robotic arm assembly is configured to move dry articles of clothing onto the folding assembly.

4. The laundry apparatus of claim 1, further comprising:

a clothing data processing assembly in communication with the at least one computer system, the clothing data processing assembly configured to determine clothing data of the article of clothing, the clothing data processing assembly having at least one sensor.

5. The laundry apparatus of claim 4, wherein the clothing data consisting of at least one of the group of: type of article of clothing, size of article of clothing, fabric type, color of article of clothing and weight of article of clothing.

* * * * *